US007866585B2

(12) United States Patent
Hall et al.

(10) Patent No.: US 7,866,585 B2
(45) Date of Patent: Jan. 11, 2011

(54) ROTARY SHAFT IMPACTOR

(76) Inventors: David R. Hall, 2185 S. Larsen Pkwy., Provo, UT (US) 84606; Ronald Crockett, 2185 S. Larsen Pkwy., Provo, UT (US) 84606; Jeff Jepson, 2185 S. Larsen Pkwy., Provo, UT (US) 84606; Tyson J. Wilde, 2185 S. Larsen Pkwy., Provo, UT (US) 84606

( * ) Notice: Subject to any disclaimer, the term of this patent is extended or adjusted under 35 U.S.C. 154(b) by 524 days.

(21) Appl. No.: 11/558,814

(22) Filed: Nov. 10, 2006

(65) Prior Publication Data

US 2008/0121746 A1 May 29, 2008

Related U.S. Application Data

(63) Continuation-in-part of application No. 11/534,177, filed on Sep. 21, 2006, now Pat. No. 7,753,303.

(51) Int. Cl.
*B02C 19/00* (2006.01)

(52) U.S. Cl. ..... 241/275; 241/300

(58) Field of Classification Search ..... 241/275, 241/300

See application file for complete search history.

(56) References Cited

U.S. PATENT DOCUMENTS

| | | | | |
|---|---|---|---|---|
| 3,970,257 | A * | 7/1976 | MacDonald et al. | 241/275 |
| RE29,798 | E | 10/1978 | Johnson | |
| 4,397,426 | A | 8/1983 | Warren | |
| 4,560,113 | A | 12/1985 | Szalanski | |
| 4,575,014 | A | 3/1986 | Szalanski | |
| RE32,363 | E | 2/1987 | Warren | |
| 4,659,026 | A | 4/1987 | Krause | |
| 4,756,484 | A | 7/1988 | Bechler | |
| 4,787,564 | A | 11/1988 | Tucker | |
| 4,796,822 | A | 1/1989 | Terrenzio | |
| 4,877,192 | A | 10/1989 | Rossouw | |
| 4,896,838 | A | 1/1990 | Vendelin | |
| 4,940,188 | A * | 7/1990 | Rodriguez et al. | 241/275 |
| 5,029,761 | A | 7/1991 | Bechler | |
| 5,323,974 | A | 6/1994 | Watajima | |
| 5,497,951 | A | 3/1996 | Watajima | |
| 5,639,030 | A | 6/1997 | Watajima | |
| 5,911,370 | A | 6/1999 | Lusty | |
| 6,171,713 | B1 | 1/2001 | Smith | |
| 6,554,215 | B1 | 4/2003 | Schultz | |
| 6,601,789 | B1 | 8/2003 | Bajadali | |
| 6,783,092 | B1 | 8/2004 | Robson | |
| 7,028,936 | B2 | 4/2006 | Condon | |
| 7,427,042 | B2 * | 9/2008 | Rodriguez | 241/300 |
| 2003/0025020 | A1 * | 2/2003 | Britzke | 241/275 |
| 2004/0011906 | A1 | 1/2004 | Bajadali | |

(Continued)

*Primary Examiner*—Faye Francis
(74) *Attorney, Agent, or Firm*—Tyson J. Wilde; Jad A. Mills; Philip W. Townsend, III

(57) ABSTRACT

In one aspect of the invention, a rotary shaft impactor has a rotor assembly connected to a rotary driving mechanism. The rotor assembly has a plurality of autogenous bed pockets, the pockets having a wall intermediate a distal and a proximal end. A least one of the pockets comprises a plurality of inserts arranged adjacent one another in a row and attached to at least the proximal or distal end wherein a first end of at least one insert is complementary to a second end of an adjacent insert.

10 Claims, 12 Drawing Sheets

U.S. PATENT DOCUMENTS

2004/0251358 A1* 12/2004 Condon ..... 241/275
2005/0150987 A1 7/2005 Hur
2005/0211810 A1 9/2005 Condon
2005/0263636 A1 12/2005 Hur
2006/0011762 A1 1/2006 Dallimore
2007/0007376 A1* 1/2007 Condon et al. ..... 241/275

* cited by examiner

ROTARY SHAFT IMPACTOR

CROSS REFERENCES

This patent application is a continuation in-part of U.S. patent application Ser. No. 11/534,177 filed on Sep. 21, 2006 now U.S. Pat. No. 7,753,303 and entitled Rotary Shaft Impactor, which is herein incorporated by reference in its entirety.

BACKGROUND OF THE INVENTION

Rotary shaft impactors are generally used to reshape or reduce the size of aggregate material. Rotary shaft impactors operate on the principle of propelling the aggregate at high velocity against a target or against other aggregate. The aggregate is generally fed through an inlet into a rotor assembly which rotates at high velocity, accelerating the aggregate out of an outlet of the rotor assembly and into a plurality of targets, sometimes referred to in the art as anvils, disposed along an inner wall of a chamber in which the rotor assembly is disposed. Because of the high velocity of the aggregate both in the rotor assembly and toward the targets, different components of the rotary shaft impactor experience high wear from the aggregate.

U.S. Pat. No. 5,029,761 by Bechler, which is herein incorporated by reference for all that it contains, discloses a liner wear plate for a vertical shaft impactor rotor including at least one wear resistant insert disposed in the liner along a path of wear formed by particulate material passed through said rotor for communication.

U.S. Pat. No. 6,171,713 by Smith et al., which is herein incorporated by reference for all that it contains, discloses an impeller shoe having a front side with a series of half column members and raised upper and lower rims that form the impact surface of the impeller shoe. The half column and raised rims are formed with carbide material formed therein in order to improve wear resistance at these critical surfaces.

U.S. Pat. No. 6,783,092 by Robson, which is herein incorporated by reference for all that it contains, discloses an anvil for use in rock crushers.

BRIEF SUMMARY OF THE INVENTION

In one aspect of the invention, a rotary shaft impactor has a rotor assembly connected to a rotary driving mechanism. The rotor assembly has a plurality of autogenous bed pockets with a wall intermediate a distal and a proximal end. At least one of the pockets comprises a plurality of inserts arranged adjacent one another in a row and attached to at least the proximal or distal end. The inserts may be attached to a replaceable tip of the proximal or distal end.

A first end of at least one insert is complementary to a second end of an adjacent insert. The inserts may have a generally rounded geometry, a generally conical geometry, a generally flat geometry, a generally hemispherical geometry, or a combination thereof. The inserts may have a coating selected from the group consisting of diamond, polycrystalline diamond, cubic boron nitride, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, cemented metal carbide, chromium, titanium, aluminum, tungsten, and combinations thereof.

The distal or proximal end may have a plurality of rows of inserts. The inserts may be press fit or brazed into either the proximal or distal end. The inserts may be compressed together laterally. The inserts may comprise a plurality of sizes. The inserts may comprise a hardness greater than the hardness of either the proximal or distal end. The inserts may protrude out of the distal or proximal end 0.010 to 3 inches. The proximal or distal ends may have a strip of a wear resistant material with a hardness of at least 60 HRc, the strip being adjacent the plurality of inserts and being attached to the proximal or distal ends. The strip may be adjacent the plurality of inserts in more than one direction or between rows of inserts. The distal or proximal end may have a plurality of faces exposed within the pockets, at least one of the faces having a plurality of inserts. The plurality of inserts may be disposed on a junction of two contiguous faces formed on at least one of the distal or proximal ends. A flow of material may be generated when the driving mechanism is in operation and material is fed into the pockets, wherein at least one insert has an axis which is adapted to intersect the direction of flow at an angle within 35 degrees.

The first and second ends of the inserts may be generally planar and the first ends may be angled so as to be generally parallel to the second ends of the adjacent inserts. The first and second ends of the inserts may be generally planar and angled. The first and second ends may be generally nonplanar. All of the first ends of the inserts may be angled with the same angle and all of the second ends of the inserts may be angled with the complementary angle.

DETAILED DESCRIPTION OF THE INVENTION AND THE PREFERRED EMBODIMENT

Figure 1:
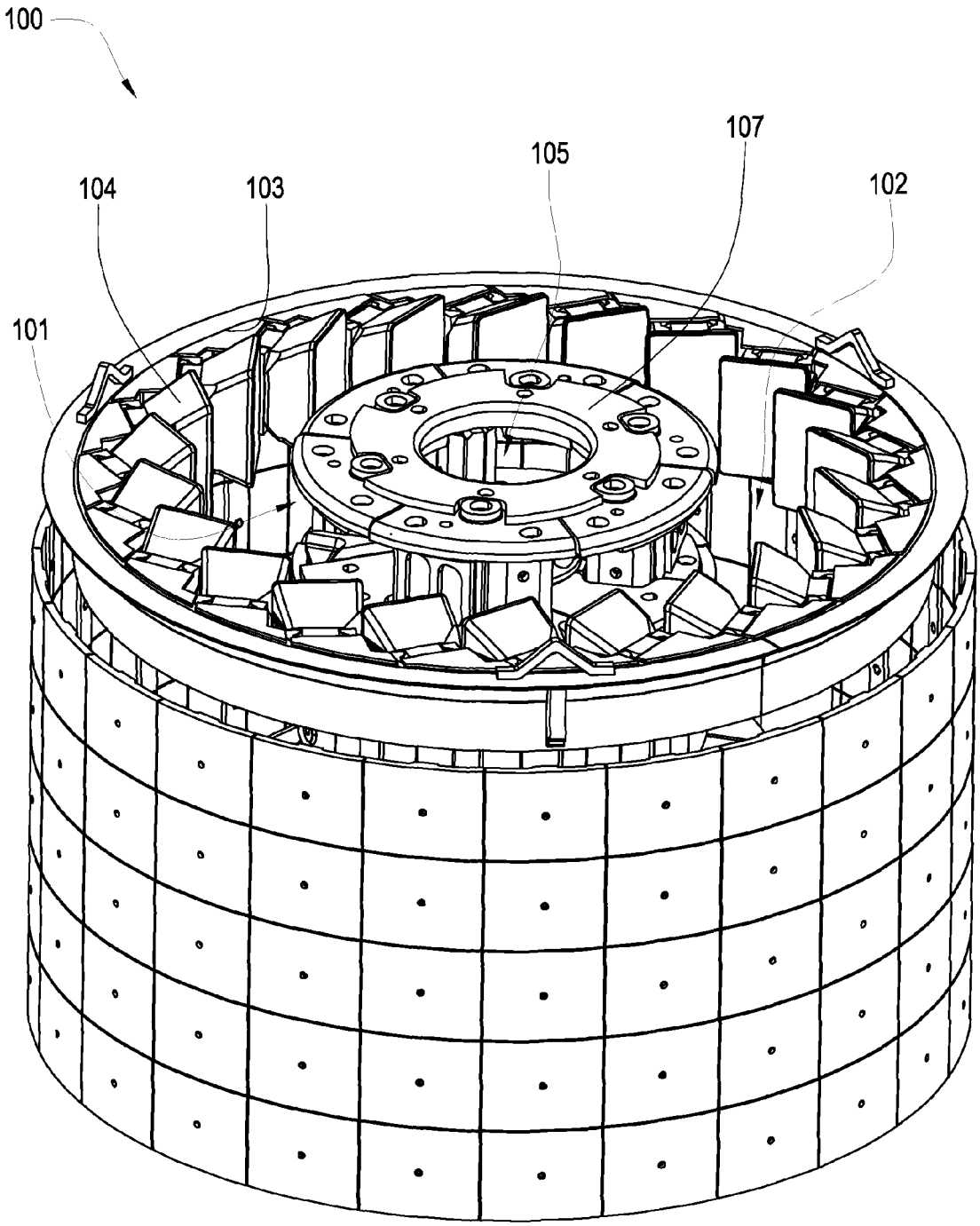
FIG. 1 is a perspective diagram of an embodiment of a rotary shaft impactor.

FIG. 1 is an embodiment of a rotary shaft impactor 100, specifically a vertical shaft impactor, for resizing and/or reshaping aggregate. A rotor assembly 101 may be disposed within a chamber 102 comprising an inner wall 103 with a plurality of targets 104 attached to the inner wall 103. The rotor assembly 101 may comprise a feed plate 107 with an inlet 105 where aggregate may be inserted. As the rotor assembly 101 rotates, generally between 600 and 2000 rpm, the aggregate is ejected centrifugally from an outlet of the rotor assembly 101 toward the inner wall 103. The rotor assembly 101 may be connected to a rotary driving mechanism. The rotary driving mechanism may be a motor or an engine.

Some embodiments the invention may include the use of targets 104. As the aggregate 210 leaves the autogenous bed pocket 200 it is directed towards the targets 104. Aggregate 210 impacting against the targets 104 is crushed and resized into smaller pieces. This impact may cause the targets 104 to wear and necessitate the replacement of some or all of the targets 104 regularly. A face of the targets 104 may comprise a diamond surface. The diamond surface may be attached to an insert, which is embedded in the face. Angled inserts 208 may be positioned along the targets 104 so that the aggregate 210 impacts the surface of the target at an angle not substantially normal to the surface of the target, as such angles are thought to cause less wear on the targets.

In some embodiments, the vertical shaft impactor 100 may include a shelf proximate the inner wall 103. This shelf may replace the targets or the shelf may be beneath the targets 104. Portions of the crushed aggregate may land and remain on the shelves. Aggregate 210 impacting against crushed aggregate remaining on the shelf generally results in smoothing or reshaping the aggregate. The aggregate remaining on the shelf may also be crushed by the later aggregate centrifugally ejected from the rotor assembly. Impactors 100 comprising the shelf are referred to in the industry as autogenous impactors, and may be advantageous with more abrasive aggregate.

Figure 2:
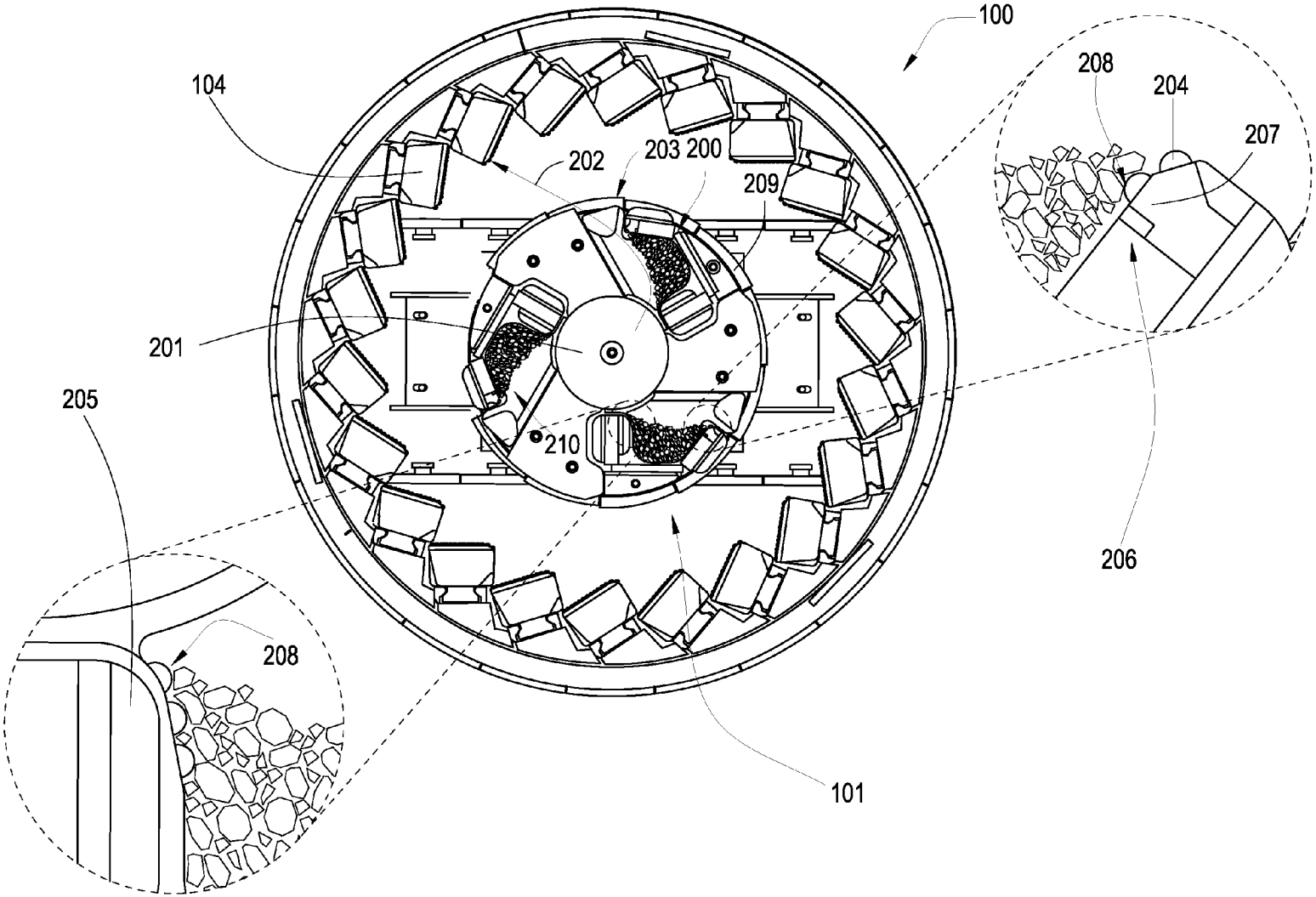
FIG. 2 is an orthogonal diagram of an embodiment of a rotor assembly.

FIG. 2 discloses an embodiment of an autogenous rotor assembly. The rotor assembly 101 comprises a plurality of autogenous bed pockets 200. The rotor assembly 101 may comprise a deflector 201, such as a cone or another component in the center of a base plate for directing the flow of aggregate. Aggregate 210 follows a wear path comprising a channel 202 connecting the inlet 105 of the rotor assembly 101 to an outlet 203 of the rotor assembly 101. Any component of the rotor assembly 101 along the wear path 202 may experience wear due to impact or friction from the aggregate moving at high velocities. Any portion of the rotary shaft impactor 100 that is disposed within the wear path may comprise a diamond surface 204, such as exposed faces at the proximal or distal end 205, 206 of the pocket 200 or of a replaceable tip 207 of the proximal or distal end 205, 206. The diamond surface 204 may be attached to an insert 208 bonded to the proximal or distal ends 105, 106 or to a replaceable tip 207 of the ends.

The rotor assembly 101 in the embodiment of FIG. 2 is generally used in either autogenous or semi-autogenous impactors. The rotor assembly 101 comprises a plurality of autogenous bed pockets 200 formed in one or more walls 209 disposed intermediate a proximal end 205 and a distal end 206. Aggregate 210 fills the beds, lining the walls 209 and protecting the walls from wear, and also acting to smooth or reshape other aggregate 210. At least one of the beds comprises a plurality of inserts 208 arranged adjacent one another in a row and attached to at least the proximal end 205 or the distal end 206. The inserts 208 may comprise a hardness greater than the hardness of either the proximal or distal end 205, 206. At least one of the inserts has a first end which is complementary to a second end of an adjacent insert. In some embodiments, the inserts may protrude out of the distal or proximal end 0.010 to 3 inches. The rotor assembly 101 may also comprise a tip 207 secured to at the ends 405, 406 along the wear path 202 and proximate the outlet 203 or the inlet 105. The tip 207 may protect the ends 205, 206 near the outlet 203 or the inlet 105. The tip 207 may also break the aggregate 210 as the aggregate 210 flows from the inlet 105 to the outlet 203.

Figure 3:
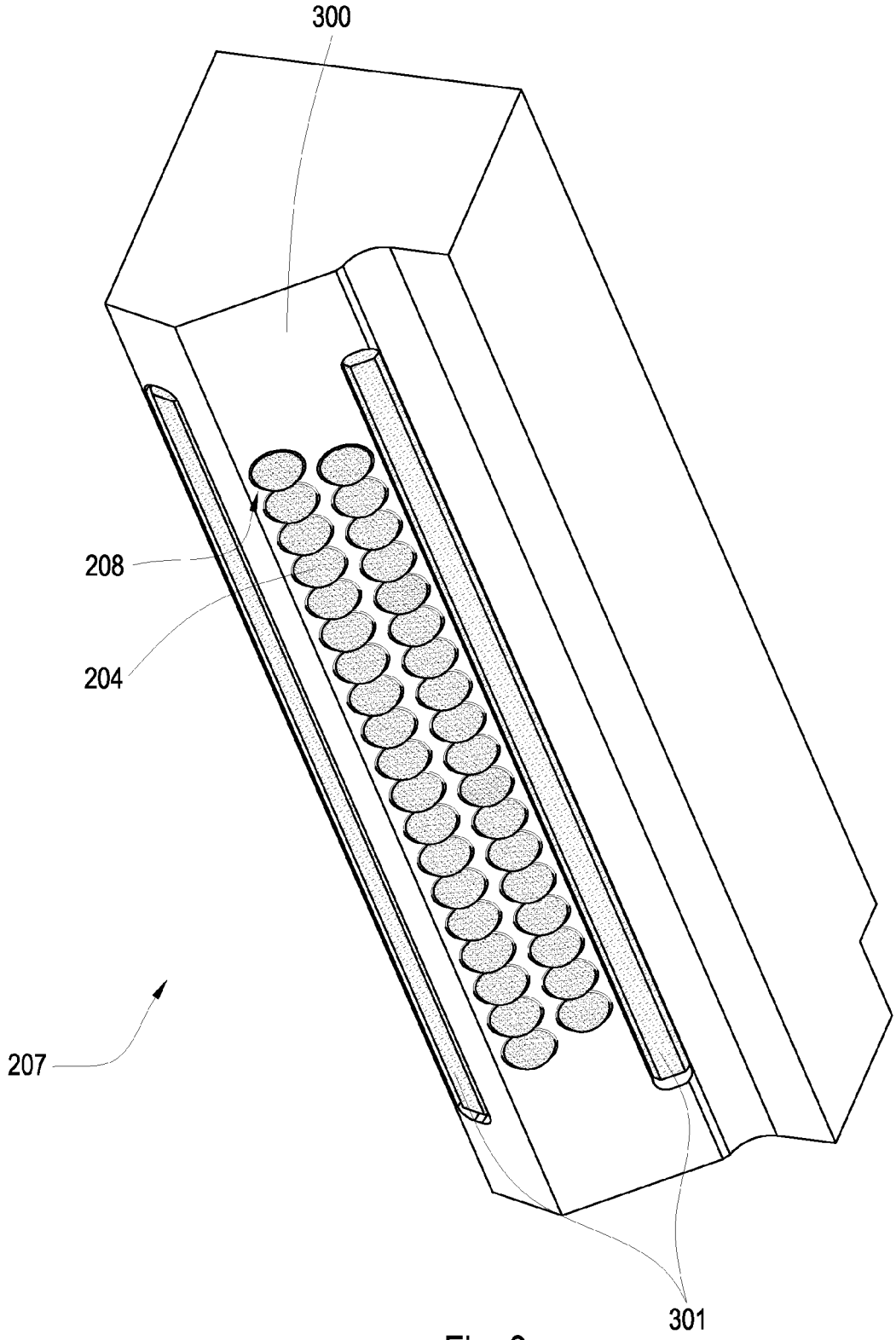
FIG. 3 is a perspective diagram of an embodiment of a tip.

Referring to the embodiment of FIG. 3, the tip 207 may comprise a diamond coating 204. The diamond coating may be disposed on a plurality of inserts 208 positioned in a row or rows along surfaces 300 of the tip 207. The surfaces 300 of the tip 207 may also comprise a surface coating with a hardness greater than 58 HRc. The tip 207 may have a geometry comprising a lip; a concave surface; a triangular surface; a flat surface; a grooved surface; or combinations thereof. The tip 207 may be made of steel, stainless steel, carbide, manganese, hardened steel, chromium, tungsten, tantalum, niobium, molybdenum, or combinations thereof. The tip body geometry may be adjusted to fit the end geometry of specific rotary shaft impactors. In some embodiments a rectangular strip 301 of hard material that spans a length of the tip 207 at high wear regions of the tip 207 may provide wear resistance, allowing for protection from impact and shearing forces due to the flow of aggregate. In some embodiments, the strip 301 may be segmented. The strip 301 may be casted or molded prior to fastening and/or bonding it to the tip 207 or chamber bed 200. Graphite or ceramics may be placed in the casted or molded material such that holes are formed in the strip 301 and the inserts 208 may be brazed or press fit into them. The strip 301 may be adjacent the plurality of inserts 208 in more than one direction and may be disposed between rows of inserts 208. By positioning the strip 301 in areas of high wear around the inserts 208 the wear resistance of the surface 300 may be increased without increasing the number of inserts 208.

Figure 4:
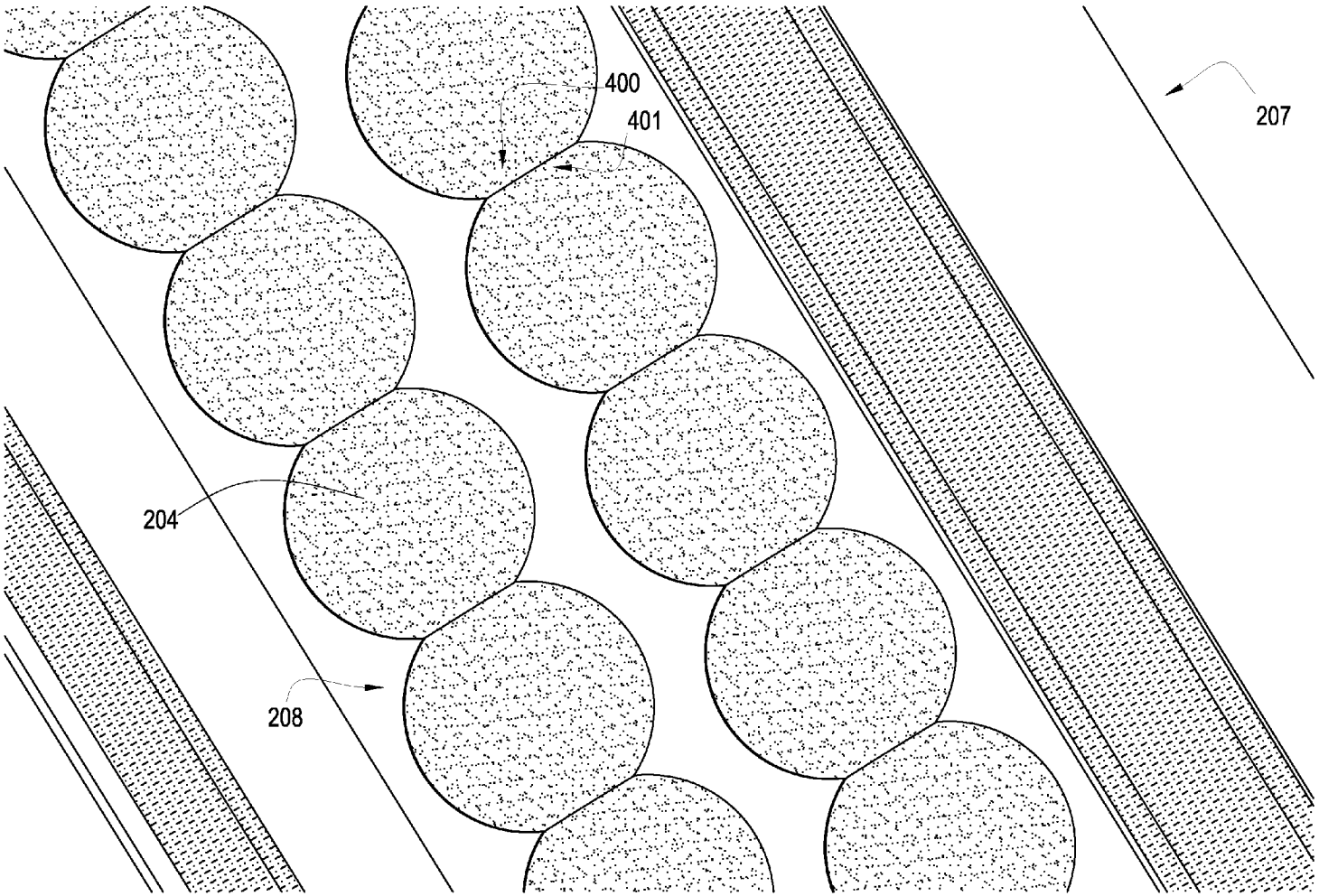
FIG. 4 is a perspective diagram of an embodiment of a row of inserts.

Referring now to the enlarged embodiment of a tip in FIG. 4, a first end 400 and a second end 401 of the inserts 208 are generally planar and the first ends are angled such that they are generally parallel to the second ends of the adjacent inserts 208. Complementary first and second ends of adjacent inserts are arranged such that the space between the two inserts 208 is substantially eliminated. With space between adjacent inserts 208 substantially eliminated wear between the inserts may be reduced. The inserts 208 may be brazed or press fit into recesses formed in the tip 207. By press fitting the inserts 208 together in a row, where the first and second ends press against each other, the inserts may compress together laterally. This may help to eliminate space between the inserts 208 and increase the resistive strength of the insert against aggregate flow forces. The inserts 208 may have a diamond coating 204. The diamond coating 204 may comprise diamond, polycrystalline diamond, cubic boron nitride, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, cemented metal carbide, chromium, titanium, aluminum, tungsten, and combinations thereof. The diamond surface 204 may comprise a binder concentration of up to 40 percent, which may help the diamond surface 204 better absorb impact forces from the flow of aggregate. The binder concentration may be unequally distributed throughout the diamond surface 204 allowing better bonding to another material while maintaining strength at exposed regions. The diamond surface 204 may comprise an average grain size of 0.5 to 300 microns. The diamond surface 204 may also comprise a polish finish, which may reduce friction and heat.

Figure 5:
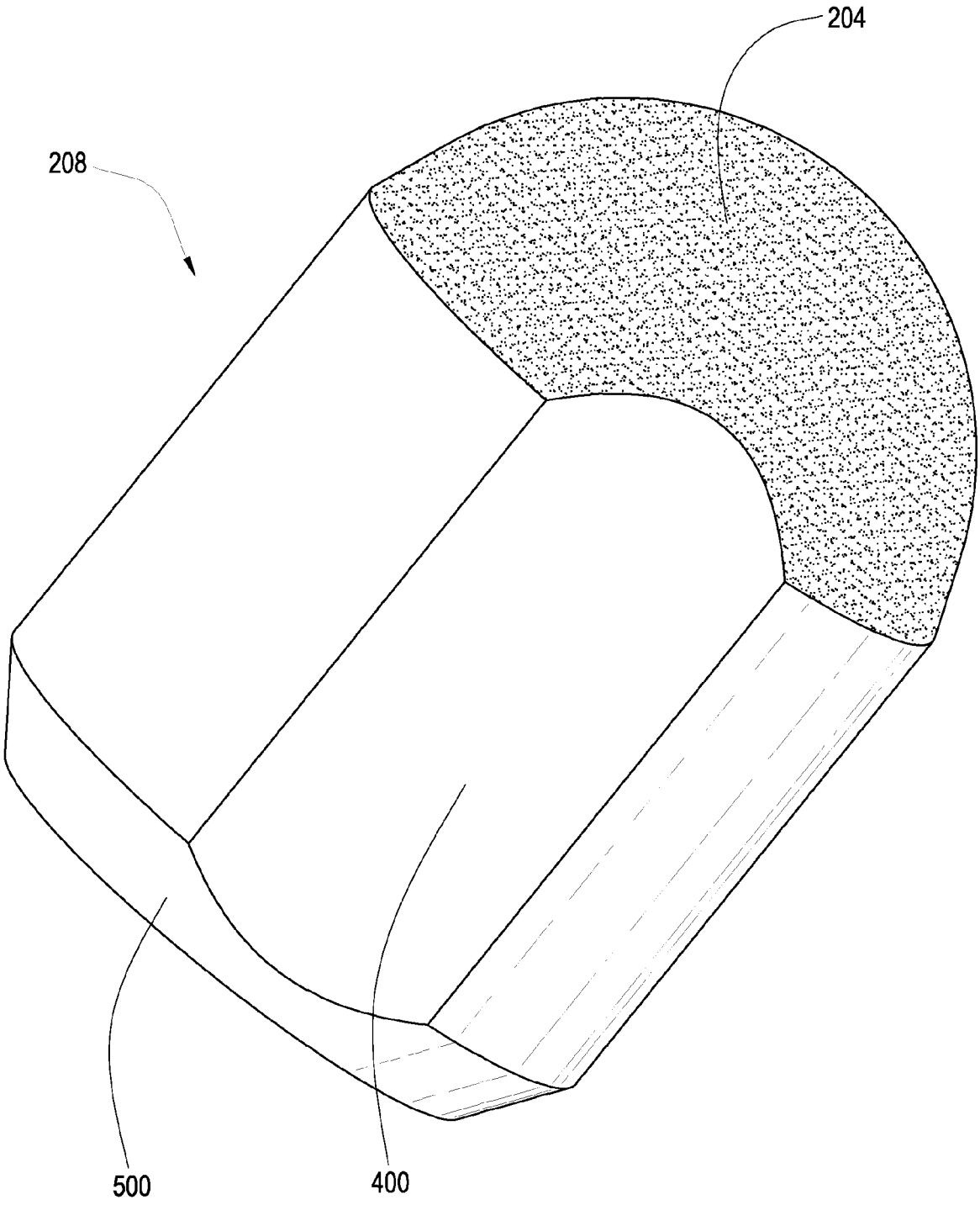
FIG. 5 is a perspective diagram of an embodiment of an insert.

In FIG. 5 a perspective embodiment of an insert 208 is shown with a first end 400 that is generally flat and parallel to a second end of an adjacent insert. The flat first end 400 allows inserts 208 to be positioned close together. In this way the wear between inserts 208 is reduced by substantially eliminating the momentum of aggregate flowing between the inserts 208. Because inserts 208 with a diamond coating 204 have a much greater wear resistance than the surface 300 of the ends 205, 206 or the tip 207, wear occurs around the inserts 208 before the inserts 208 wear themselves. Therefore it is believed that by reducing the amount and velocity of aggregate impacting on the faces 300 proximate the inserts the overall life expectancy of the ends 205, 206 will increase. A radius 500 is shown opposite the diamond surface 204. The chamfer 500 is believed to reduce the stress where the bottom of a press fit insert 208 engages the recess.

Figure 6:
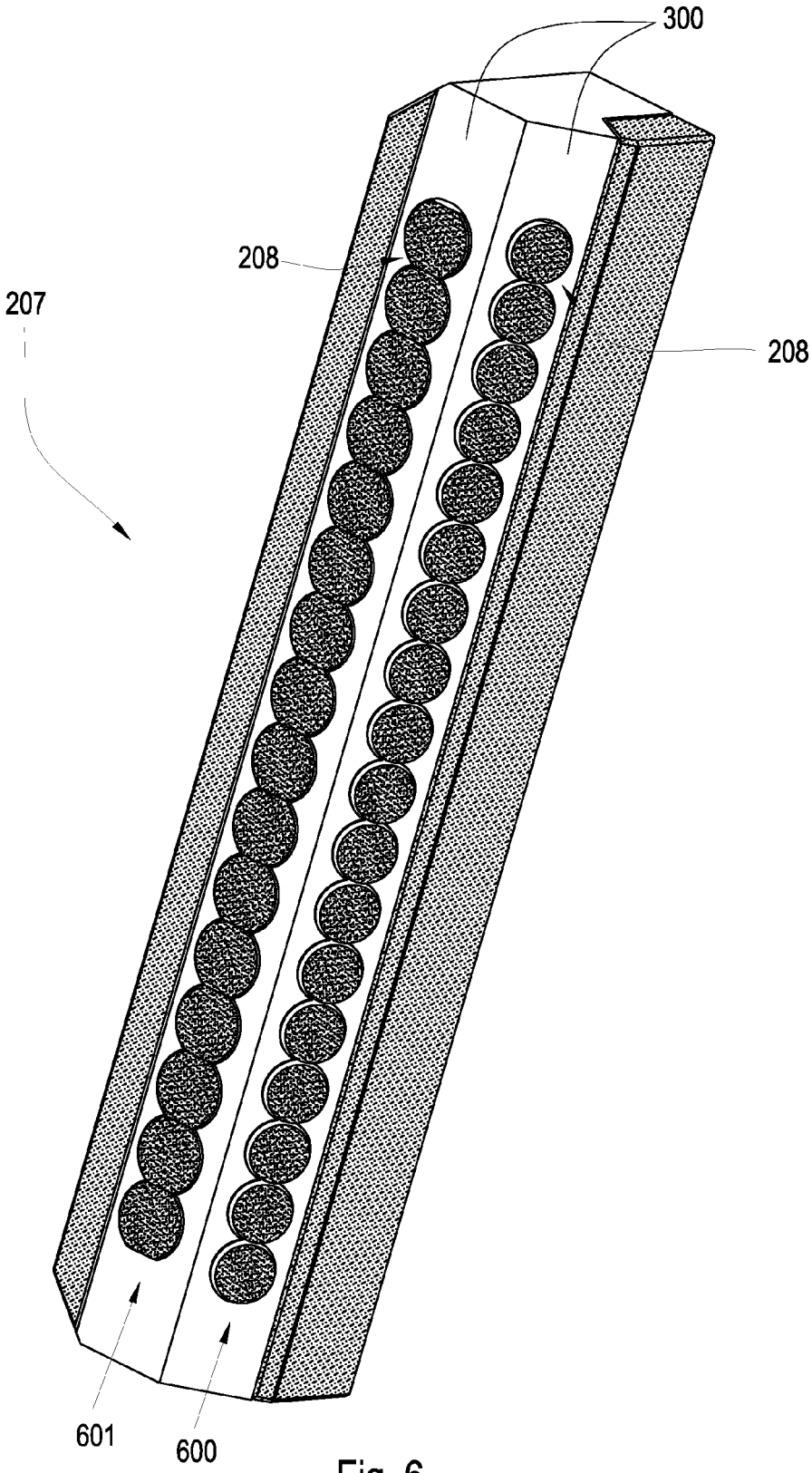
FIG. 6 is a perspective diagram of another embodiment of a tip.

Referring now to the embodiment of a tip 207 in FIG. 6 the inserts 208 may be disposed on a plurality of faces 300 exposed within the bed pockets (shown in FIG. 2). Multiple faces 300 within the bed pocket may allow for manipulation of impact angles between aggregate and inserts. Each face 300 may comprise a plurality of inserts 208. The first row 600 may be positioned on a face 300 such that it is covered by aggregate (not shown), thus protecting the first row 600 from excessive wear. The positioning of the inserts 208 and the faces 300 may also help control how the aggregate impacts the second row 601. Preferably the impact angle is within 35 degrees. Head on impact is believed be the most efficient at breaking the aggregate, while more acute angles are believed to cause less wear on the insert 208 and prolong the life of the insert 208. In some embodiments, the plurality of inserts may comprise a plurality of sizes. FIG. 6 discloses a plurality of inserts 208 with a combination of insert geometries. The inserts may comprise a generally rounded geometry, a generally conical geometry, a generally flat geometry, a generally hemispherical geometry, or a combination thereof.

Figure 7:
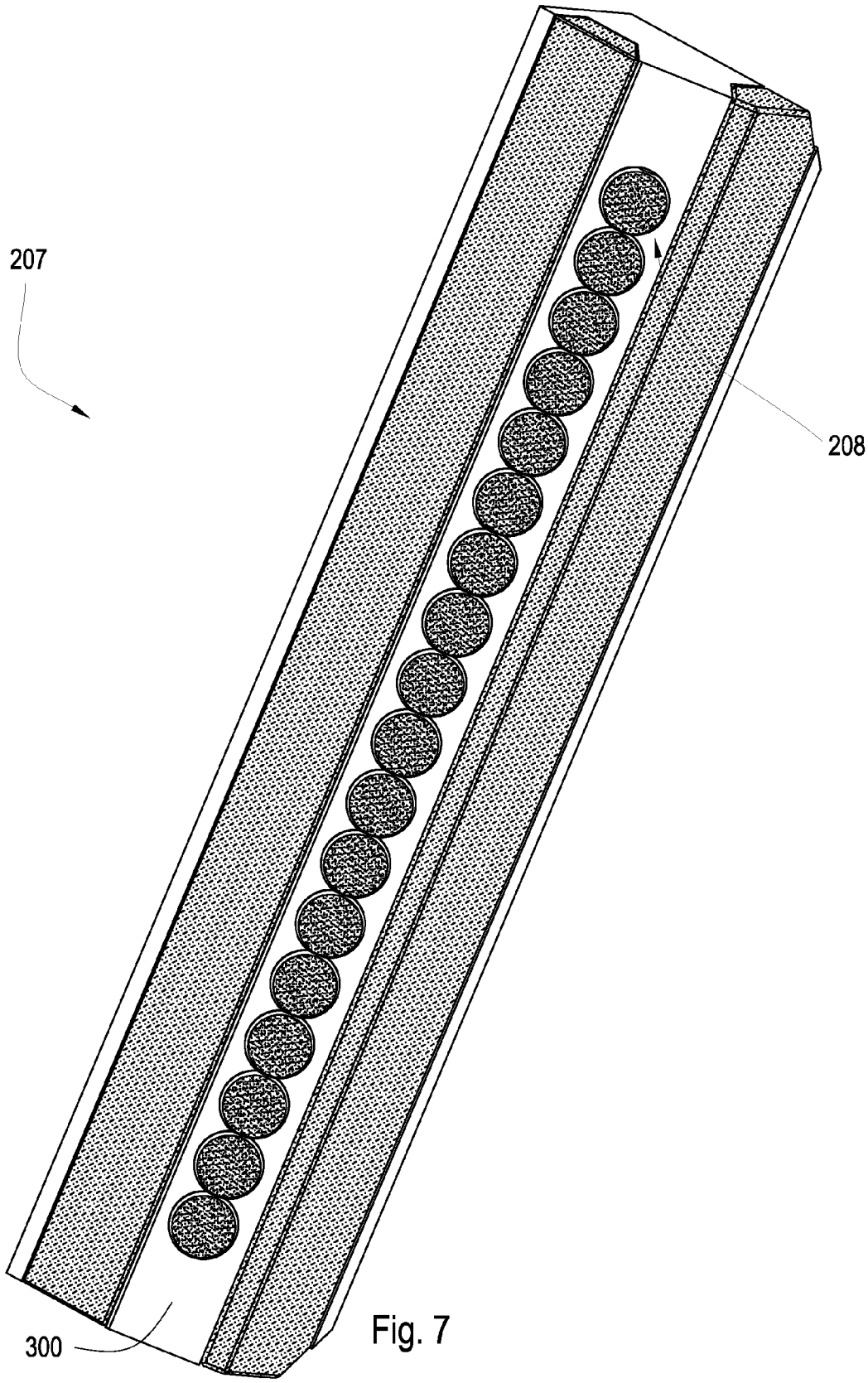
FIG. 7 is a perspective diagram of another embodiment of a tip.

Referring now to FIG. 7 the inserts 208 may be disposed on a single face 300. In some applications wear resistance requirements may be lower than others. Because the cost of manufacturing a tip 207 may be correlated to the number of inserts present on the tip, it may be advantageous to use only a single row of inserts 208. In addition, if the flow direction of the aggregate (not shown) is already positioned to obtain the desired impact angle a single face 300 may be sufficient.

Figure 8:
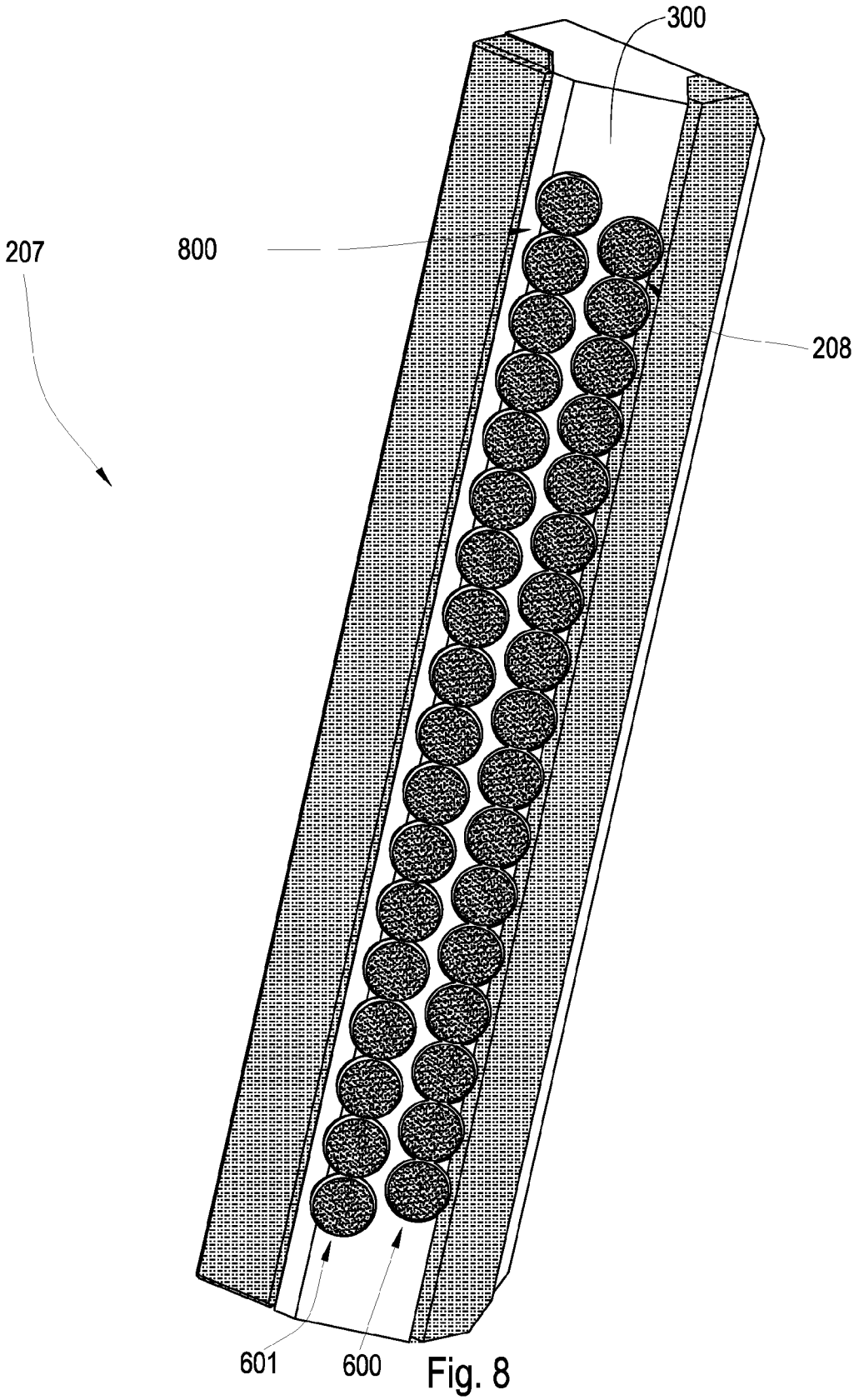
FIG. 8 is a perspective diagram of another embodiment of a tip.

Referring now to the embodiment of a tip 207 in FIG. 8, the inserts 208 may be disposed in a plurality of rows on a single face 300. The first row 600 may be arranged such that a junction 800 between the first and second ends of the inserts is offset from a junction 800 between the first and second ends of the inserts 208 in the second row 601. It is believed that this arrangement minimizes wear between the inserts. The plurality of rows on a single face 300 may be advantageous in cases where the desired impact angle can be obtained without the use of multiple faces.

Figure 9:
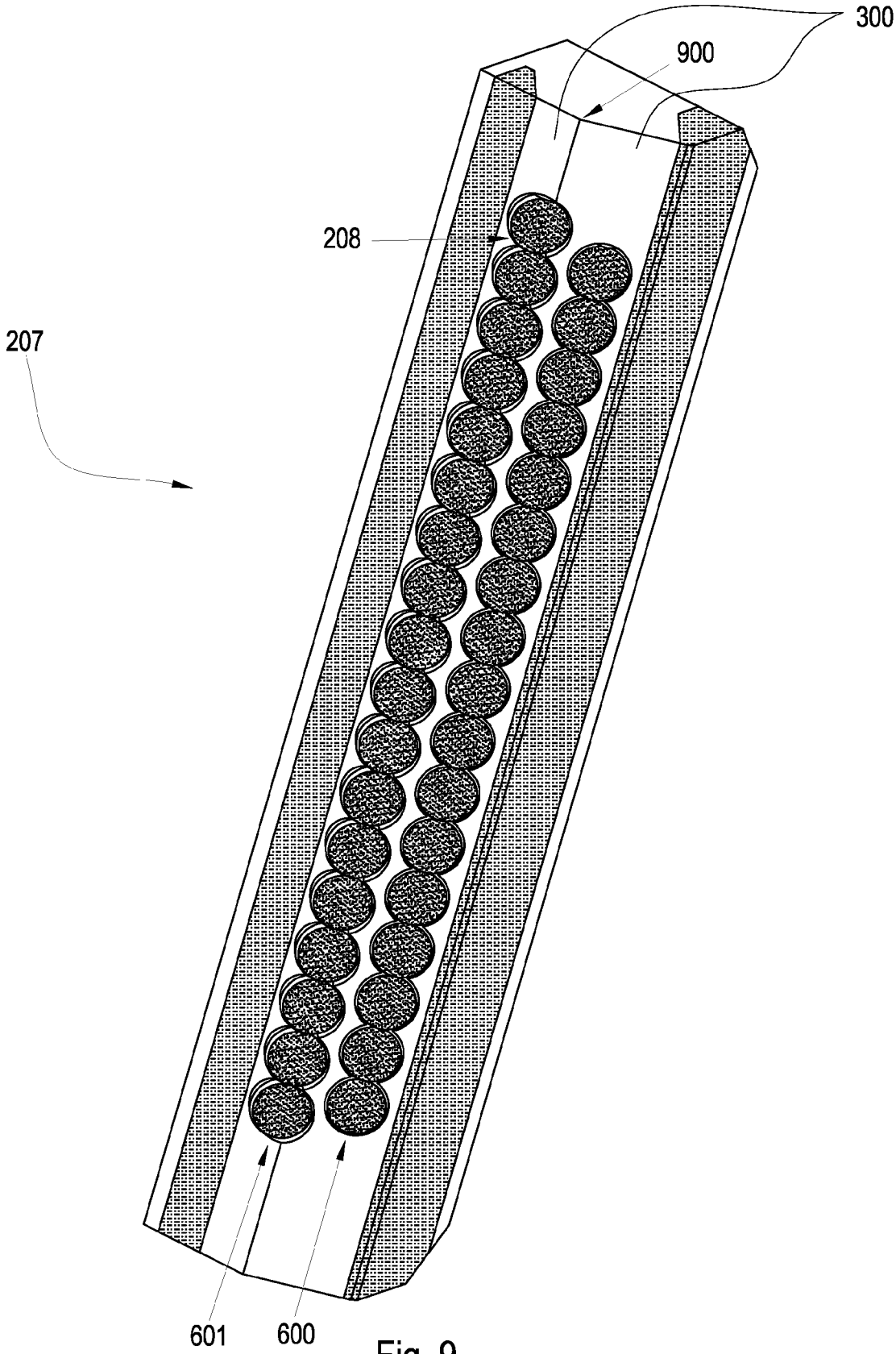
FIG. 9 is a perspective diagram of another embodiment of a tip.

Referring now to FIG. 9 the inserts 208 may be disposed along a ridge 900 of two contiguous faces 300. Placing inserts 208 along the ridge 900 may allow for further manipulation of aggregate impact angle. A first row of inserts 600 may be positioned in such a way as to shield the bottom of a second row of inserts 601 and to direct the flow of aggregate (not shown) towards impact with the second row 601 at an angle which yields the desired aggregate size and shape. In some embodiments the inserts 208 may protrude beyond the face 300 of the tip 207 by 0.010 to 3.00 inches, or the inserts 208 may be flush with the face 300. When the aggregate impacts against the protrusion the aggregate is subjected to a bending force which may help increase the size reduction of aggregate and/or lower the energy requirements of the rotary shaft impactor. Without the protecting role of the first row of inserts 600 the protruding second row of inserts 601 may be vulnerable to wear resulting from the moving aggregate.

Figure 10:
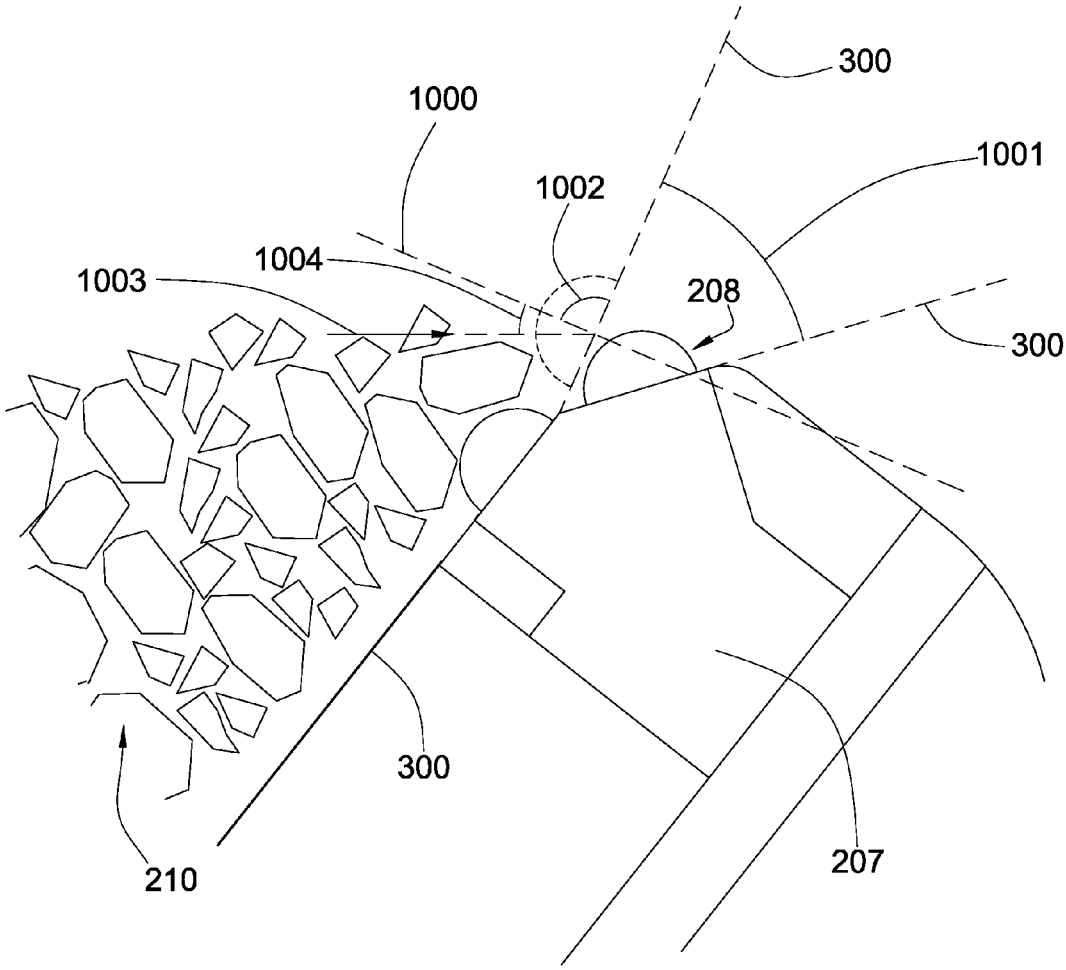
FIG. 10 is a orthogonal diagram of another embodiment of a rotor assembly.

Referring now to FIG. 10, the plurality faces 300 may be positioned relative one another with a face angle 1001 of between 1 and 90 degrees. An insert 208 may be positioned relative a face 300 such that a central axis 1000 of the insert 208 forms an insert angle 1002 with the face 300. The face angle 1001 and the insert angle 1002 may be manipulated in conjunction one with another such that a direction 1003 of aggregate flow forms a flow angle 1004 with the central axis 1000 within 35 degrees. Aggregate 210 impacting the insert 208 at a flow angle 1004 within 35 degrees is believed to cause less wear on the insert 208. Each insert 208 may be oriented at a different angle along the tip 207.

Figure 11:
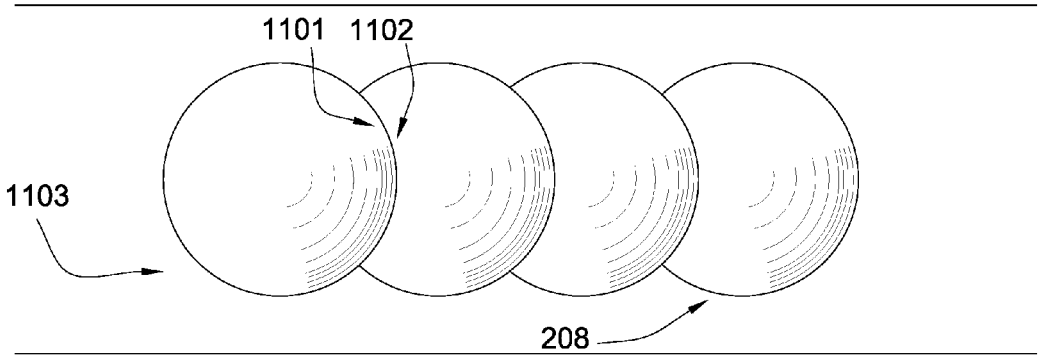
FIG. 11 is an orthogonal diagram of another embodiment of a row of inserts.
Figure 12:
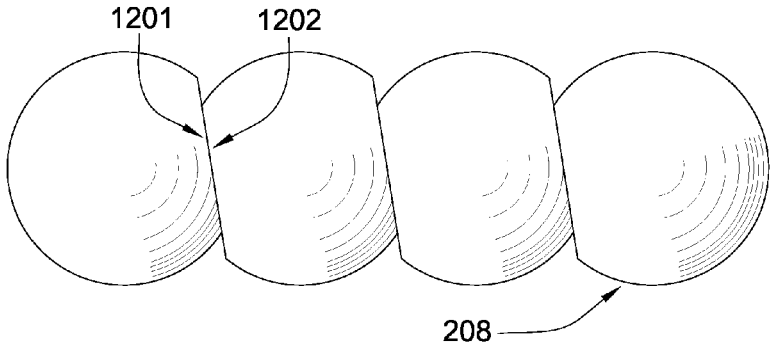
FIG. 12 is an orthogonal diagram of another embodiment of a row of inserts.
Figure 13:
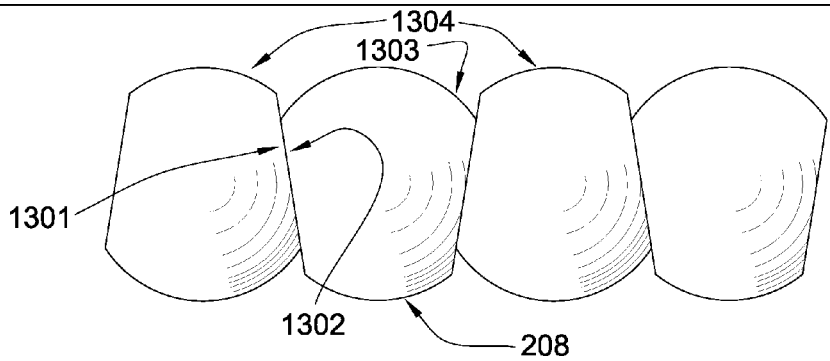
FIG. 13 is an orthogonal diagram of another embodiment of a row of inserts.
Figure 14:
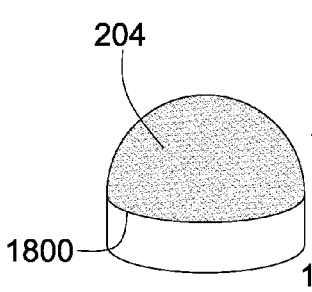
FIG. 14 is a perspective diagram of an embodiment of an insert.
Figure 15:
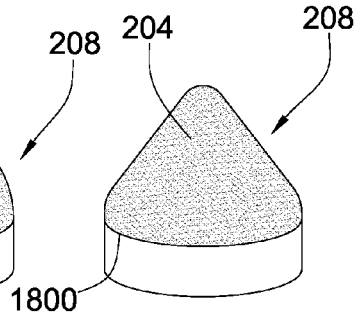
FIG. 15 is a perspective diagram of another embodiment of an insert.
Figure 16:
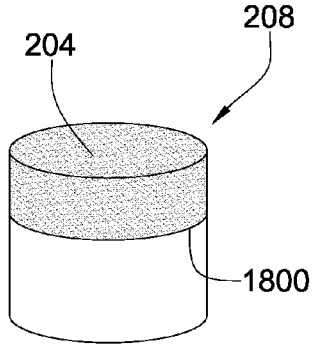
FIG. 16 is a perspective diagram of another embodiment of an insert.
Figure 17:
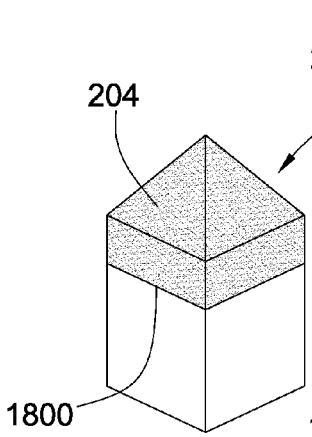
FIG. 17 is a perspective diagram of another embodiment of an insert.
Figure 18:
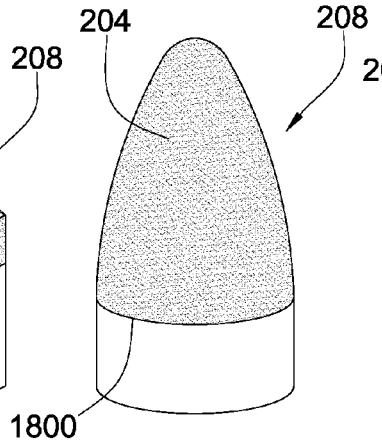
FIG. 18 is a perspective diagram of another embodiment of an insert.
Figure 19:
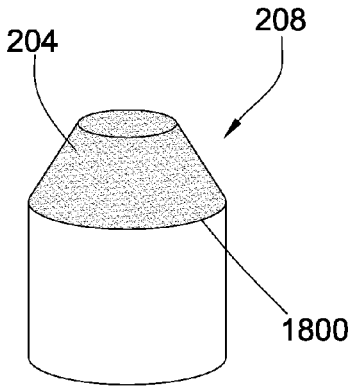
FIG. 19 is a perspective diagram of another embodiment of an insert.

FIGS. 11 to 13 are different embodiments of first and second complementary ends of the inserts 208. The inserts 208 may have a first end which is flat, angular, slanted, curved, rounded or combinations thereof. FIG. 11 is an embodiment of a row of inserts in which a first end 1101 is generally rounded complementary to a second end 1102 of an adjacent insert 208. Since the first end 1101 is interlocked with the second end 1102 it is believed that an impact to one of the inserts will be shared by its adjacent inserts. By distributing the force of aggregate impact throughout an entire row 1103 it is believed that the inserts 208 will have a greater resistive force and a longer life. Additionally, the complementary first and second ends 1101, 1102 serve to reduce the space between the inserts 208 thus reducing the amount of aggregate flowing between the inserts 208.

FIG. 12 is an embodiment of a row of inserts 208 in which all of the first ends 1201 are generally planar and angled with the same angle and are complementary to the second ends 1202 of an adjacent inserts. This design not only attempts to reduce wear by reducing the space between the inserts 208 but is also believed to change the flow between the inserts, which will reduce the energy of the flowing material. It is therefore believed that the embodiment of inserts 208 shown in FIG. 12 will cause a reduction in the momentum of aggregate flowing between the inserts 208.

FIG. 13 is an embodiment of a row of inserts 208 in which a first end 1301 is generally planar and angled complementary to a second end 1302 of an adjacent insert 208 This arrangement creates a middle insert 1303 that comprises a wedge between two adjacent inserts 1304.

FIGS. 14 to 22 are different embodiments of the insert 208. The insert 208 may comprise a geometry with a generally domed shape, as in the embodiment of FIG. 14; a generally conical shape, as in the embodiment of FIG. 15; a generally flat shape, as in the embodiment of FIG. 16; a generally pyramidal shape, as in the embodiment of FIG. 17; a generally paraboloid shape, as in the embodiment of FIG. 18; a generally frustoconical shape, as in the embodiment of FIG.

Figure 20:
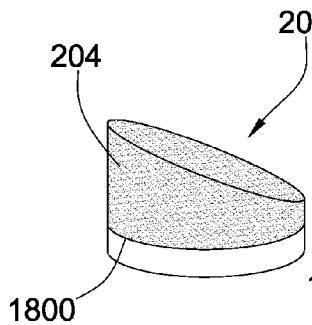
FIG. 20 is a perspective diagram of another embodiment of an insert.
Figure 21:
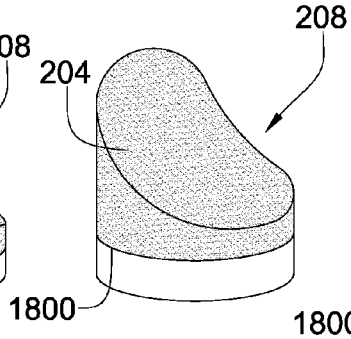
FIG. 21 is a perspective diagram of another embodiment of an insert.
Figure 22:
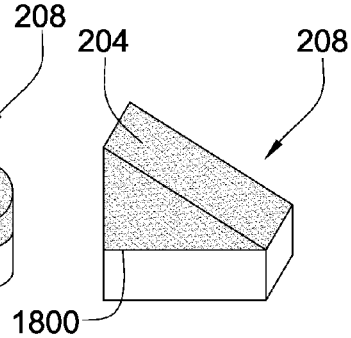
FIG. 22 is a perspective diagram of another embodiment of an insert.

19; an elliptical wedge shape, as in the embodiment of FIG. 20; a generally scoop shape, as in the embodiment of FIG. 21; a rectangular wedge shape, as in the embodiment of FIG. 22; a generally asymmetric shape; a generally rounded shape; a generally polygonal shape; a generally triangular shape; a generally rectangular shape; a generally concave shape; a generally convex shape; a chamfer; a conic section; or combinations thereof. The diamond surface 204 may be bonded to a substrate in a high temperature high pressure press at a planar or nonplanar interface 1800 of the insert 208. Preferably the diamond surface is a cobalt infiltrated polycrystalline diamond bonded to a tungsten carbide substrate.

Whereas the present invention has been described in particular relation to the drawings attached hereto, it should be understood that other and further modifications apart from those shown or suggested herein, may be made within the scope and spirit of the present invention.

What is claimed is:

1. A rotary shaft impactor, comprising:

a rotor assembly connected to a rotary driving mechanism;

the rotor assembly comprising a channel connecting an aggregate inlet located near a center of rotor assembly and an outlet located proximate a periphery of the rotor assembly;

a replaceable tip is located near the outlet and configured to protect the outlet from a flow of aggregate;

the tip is positioned at an impact angle against the flow;

the replaceable tip comprises a plurality of inserts press fit into a surface of the tip;

the inserts comprise geometry of a generally conical shape that protrudes beyond the surface of the tip; and each insert comprises a flat that allows the inserts to be positioned close together; the inserts are arranged adjacent one another in a row along a length of the tip and compressed together laterally along the length such that space between the flats is substantially eliminated.

2. The impactor of claim 1, wherein the inserts comprise a coating selected from the group consisting of diamond, polycrystalline diamond, cubic boron nitride, and combinations thereof.

3. The impactor of claim 1, wherein a first end of the insert is flat, angular, slanted, curved, rounded or combinations thereof.

4. The impactor of claim 1, wherein the inserts comprise a plurality of sizes.

5. The impactor of claim 1, wherein the inserts protrude out of at least the distal or proximal end 0.010 to 3 inches.

6. The impactor of claim 1, wherein the proximal or distal ends comprises a strip of a wear resistant material with a hardness of at least 60 HRc, the strip being adjacent the plurality of inserts and being attached to the proximal or distal ends.

7. The impactor of claim 6, wherein the strip is adjacent the plurality of inserts in more than one direction or between rows of inserts.

8. The impactor of claim 1, wherein the plurality of inserts is disposed on a junction of two contiguous faces formed on at least one of the distal or proximal ends.

9. The impactor of claim 1, wherein a flow of material is generated when the driving mechanism is in operation and material is fed into the channels, wherein at least one insert is adapted to intersect the flow at an angle within 35 degrees of an insert axis.

10. The impactor of claim 1, wherein all first ends of the inserts are angled with the same angle and all second ends of the inserts are angled with a complementary angle.

* * * * *